US007292799B2

(12) United States Patent
Oki

(10) Patent No.: US 7,292,799 B2
(45) **Date of Patent: *Nov. 6, 2007**

(54) IMAGE FORMING APPARATUS USING DETECTION OF TONER IMAGE ON IMAGE BEARING MEMBER

(75) Inventor: Makoto Oki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/609,596

(22) Filed: Dec. 12, 2006

(65) Prior Publication Data

US 2007/0092275 A1 Apr. 26, 2007

Related U.S. Application Data

(62) Division of application No. 10/943,838, filed on Sep. 20, 2004, now Pat. No. 7,171,133.

(30) Foreign Application Priority Data

Sep. 22, 2003 (JP) ..... 2003-330055

(51) Int. Cl.
*G03G 15/00* (2006.01)
*G03G 15/08* (2006.01)

(52) U.S. Cl. ..... 399/49; 399/27; 399/74

(58) Field of Classification Search ..... 399/27, 399/49, 60, 64, 74, 98
See application file for complete search history.

(56) References Cited

U.S. PATENT DOCUMENTS 4,801,980 A 1/1989 Arai et al. ..... 399/74 X
4,878,082 A 10/1989 Matsushita et al. ..... 399/49
5,477,312 A 12/1995 Hori
7,171,133 B2 * 1/2007 Oki ..... 399/49

FOREIGN PATENT DOCUMENTS

| | | |
|---|---|---|
| JP | 63-110476 | 5/1988 |
| JP | 63-110477 | 5/1988 |
| JP | 03-134678 | 6/1991 |
| JP | 06-3886 | 1/1994 |
| JP | 07-36230 | 2/1995 |
| JP | 07-36231 | 2/1995 |
| JP | 11-295941 | 10/1999 |

OTHER PUBLICATIONS

"Electrophotography-Bases and Applications." Society of Electrophotography of Japan, Corona Publishing Co., Ltd., pp. 286-287 (1988) w/English translation.

* cited by examiner

*Primary Examiner*—Sandra I. Brase
(74) *Attorney, Agent, or Firm*—Fitzpatrick, Cella, Harper & Scinto

(57) ABSTRACT

In an image forming apparatus provided with an image forming portion for forming a toner image on a rotatable image bearing member, and a detecting portion for detecting a toner image for detection formed on the image bearing member, wherein the state of the image forming portion is controlled on the basis of the result of detection of the toner image by the detecting portion, and the result of detection of the surface of the image bearing member on which the toner image is not formed by the detecting portion, the detection of the surface of the image bearing member on which the toner image is not formed by the detecting portion is effected at each substantially 1/n cycle (n being 2 or greater integer) in one revolution of the image bearing member.

6 Claims, 9 Drawing Sheets

TONER SPECTRAL CHARACTERISTICS

IMAGE FORMING APPARATUS USING DETECTION OF TONER IMAGE ON IMAGE BEARING MEMBER

BACKGROUND OF THE INVENTION

This application is a divisional of application Ser. No. 10/943,838, filed Sep. 20, 2004 now U.S. Pat. No. 7,171,133.

1. Field of the Invention

The invention relates to an image forming apparatus of, for example, an electrophotographic type, an electrostatic recording type or the like, and particularly to an image forming apparatus using density detecting means for detecting the density or the amount of adherence of a toner image.

2. Related Background Art

A toner density sensor is shown in FIG. 8 of the accompanying drawings. The sensor comprises a sensor case 29, a light emitting element (LED) 50 and a light receiving element (PD) 51. The detection of toner density is effected by turning on the LED 50 to thereby apply light to a reference toner patch (hereinafter referred to as the patch) on a photosensitive drum 17 which is an image bearing member, and detecting light reflected from the patch or the surface of the photosensitive drum by a photodiode 51. (See, for example, "Electrophotography-Bases and Applications" compiled by the Society of Electrophotography of Japan, CORONA PUBLISHING Co., LTD., Jun. 15, 1988, pp. 286-287.) As the wavelength of the LED 50, use is made of an infrared area, and here, use is made of a wavelength of 950 nm. The relation between the detected reflected light and the toner density exhibits such a characteristic as shown in FIG. 7 of the accompanying drawings and therefore, the density is calculated by the use of this relation. Particularly, a black toner and color toners (yellow, magenta and cyan) differ in the light reflecting and absorbing characteristics of the toner from one another. The black (Bk) toner uses carbon black and therefore absorbs light in the entire wavelength area and therefore, the quantity of reflected light lowers as the toner density rises. On the other hand, the color toners, as shown in FIG. 9 of the accompanying drawings, differ in characteristic in a visible area (400 nm 700 nm) from one another. In the infrared area, however, any toner exhibits a reflecting characteristic and therefore, by using the LED 50 of the infrared wavelength, it is possible to detect any change in the toner density. In the case of the color toners, infrared reflection is used and therefore, the quantity of reflected light increases as the toner density rises.

The toner patch can be formed by forming a latent image on the charged photosensitive drum by exposing means such as a laser, and developing the latent image by a toner by the use of developing means.

The toner patch is formed in a gradation in some cases, and is formed in a plurality of gradations in some cases.

Now, the toner density sensor often has its sensor detecting surface stained with dust or the like including a scattered toner present in an image forming apparatus. In order to prevent the stains, a shutter can be attached to the sensor detecting surface, or in order to remove the adhering stains, cleaning means can be provided, but this leads to the problem of a cost or a space in the apparatus. Therefore, light is applied to the surface of the photosensitive drum to which the toner does not adhere, and the quantity of reflected light therefrom is detected to thereby detect the stain of the sensor surface, and in conformity therewith, the quantity of light of the LED 50 or the output of the photodiode 51 is corrected (see, for example, Japanese Patent Application Laid-Open No. H07-36230).

Also, the output is varied by the eccentricity of the photosensitive drum and therefore, heretofore, phase detecting means has been provided on the image bearing member (see, for example, Japanese Patent Application Laid-Open No. H07-36231), or during image forming, a marker for position detection has been formed as an image and on the basis thereof, sensor output correction has been effected (see, for example, Japanese Patent Application Laid-Open No. H11-295941).

Further, in order to prevent the vibration of a transfer belt or a conveying belt, there is also means for attaching a supporting member to the back side of the belt to thereby stabilize the output (see, for example, Japanese Patent Application Laid-Open No. H06-3886).

The toner density sensor of the above-described construction, however, operates well, but suffers from the following problems.

When correction is effected on the surface of the photosensitive drum, the corrected value deviates greatly due to the eccentricity component of the drum in some cases. Therefore, it is also conceivable to provide, for example, a sensor for phase control and combine such means as will put a detecting position in order (for example, a combination with Japanese Patent Application Laid-Open No. H07-36231), but this requires much cost and suffers from the problem of space. This is also a method of forming a marker (for example, Japanese Patent Application Laid-Open No. H11-295941), but this suffers from the problem that the marker forming time and sequence become complicated. Further, when this method is adopted in a transfer belt, the addition or the like of a supporting member is necessary, and this also leads to the problem of increased cost.

SUMMARY OF THE INVENTION

The present invention can provide an image forming apparatus which can effect the correction of an output fluctuation due to the stain or the like of density detecting means in a simple construction.

A preferred prefeffed image forming apparatus for achieving this object has:

image forming means for forming a toner image on a rotatable image bearing member;

detecting means for detecting a toner image for detection formed on the image bearing member; and control means for controlling the state of the image forming means on the basis of the result of detection of the toner image by the detecting means, and the result of detection of the surface of the image bearing member on which the toner image is not formed by the detecting means;

wherein the control means effects the detection of the surface of the image bearing member on which the toner image is not formed by the detecting means at each substantially 1/n cycle (n being 2 or greater integer) in one revolution of the image bearing member.

Another preferred image forming apparatus has:

image forming means for forming a toner image on a movable belt-shaped image bearing member;

detecting means for detecting a toner image for detection formed on the image bearing member in an area supported by a rotary member; and control means for controlling the state of the image forming means on the basis of the result of detection of the toner image by the detecting means, and the result of detection of the surface of the image bearing member on which the toner image is not formed by the detecting means;

wherein the control means effects the detection of the surface of the image bearing member on which the toner image is not formed by the detecting means at each substantially 1/n cycle (n being 2 or greater integer) in one revolution of the rotary member.

Still another preferred image forming apparatus has:

image forming means for forming a toner image on an image bearing member;

transferring means capable of transferring the toner image on the image bearing member to a transfer material borne and transferred by a belt member;

detecting means for detecting a toner image for detection formed on the belt member in an area supported by a rotary member; and control means for controlling the state of the image forming means on the basis of the result of detection of the toner image by the detecting means, and the result of detection of the surface of the belt member on which the toner image is not formed by the detecting means;

wherein the control means effects the detection of the surface of the image bearing member on which the toner image is not formed by the detecting means at each substantially 1/n cycle (n being 2 or greater integer) in one revolution of the rotary member.

DESCRIPTION OF THE PREFERRED EMBODIMENTS

The present invention will be described in the following embodiments.

First Embodiment

Figure 1:
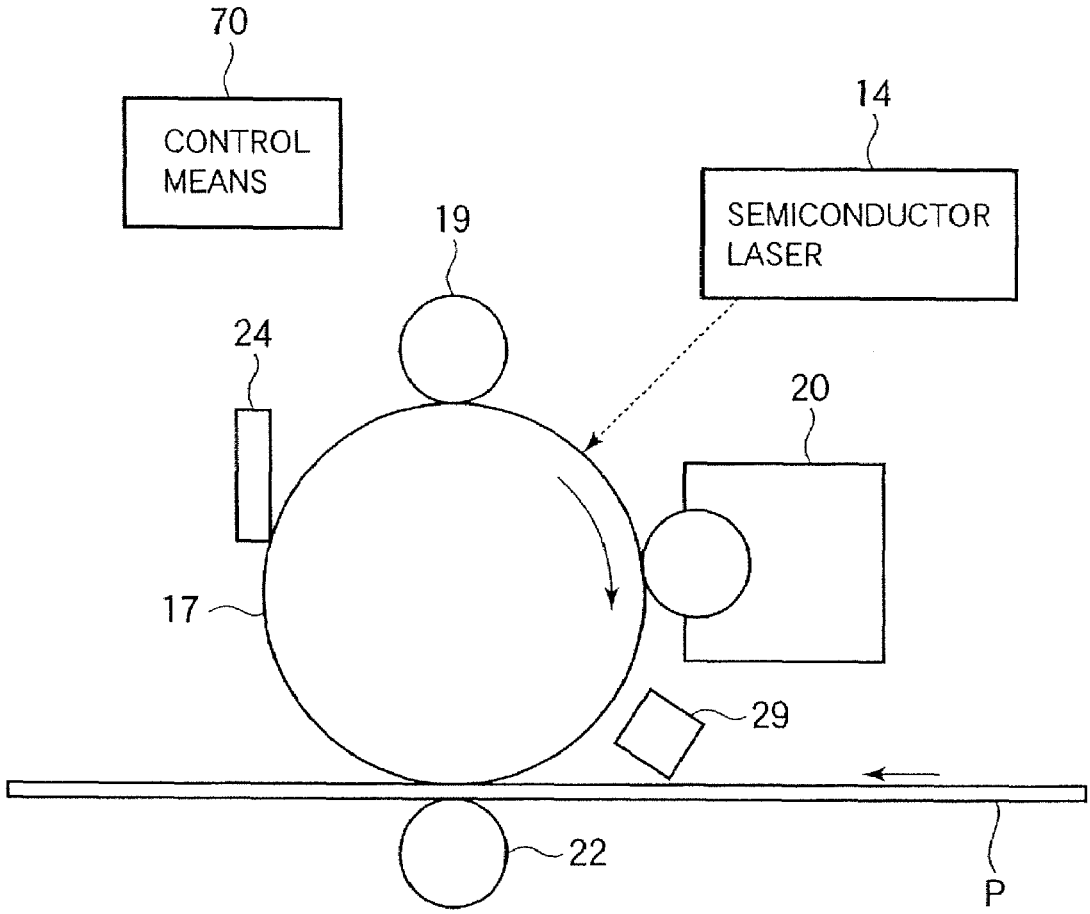
FIG. 1 schematically shows the construction of an image forming apparatus according to a first embodiment of the present invention.

FIG. 1 schematically shows the construction of an embodiment of the image forming apparatus carrying a toner density sensor thereon.

The image forming apparatus to which the present invention can be applied can be of a construction in which a latent image corresponding to an image information signal is formed on an image bearing member such as, for example, a photosensitive member or a dielectric material by an electrophotographic process, an electrostatic recording process or the like; this latent image is developed by a developing apparatus to thereby form a visible image (toner image), and this visible image is directly or indirectly transferred onto a transfer material such as paper and is made into a permanent image by fixing means.

Reference is first had to FIG. 1 to describe the general construction of an embodiment of the image forming apparatus of the present invention.

A photosensitive drum 17 which is an image bearing member is uniformly charged to e.g. minus by a primary charging device 19. Thereafter, it receives the application of a laser beam emitted from a semiconductor laser 14 or the like, whereby an electrostatic latent image conforming to an image signal is formed on the photosensitive drum 17. This electrostatic latent image is developed into a visible image (toner image) by a developing device 20. At this time, for example, a DC bias component and an AC bias component conforming to an electrostatic latent image forming condition are superimposed upon each other to improve developing efficiency and are applied to the developing device. This toner image is transferred to a transfer material P by the action of a transfer charging device 22. Also, any residual toner on the photosensitive drum after the transfer is removed by a cleaner 24, whereafter advance is made to the charging step again.

In this image forming apparatus, in order to correct the toner density in the developing device 20 varied by the developing operation, the density of a patch-like toner image (hereinafter referred to as the patch) obtained by developing the electrostatic latent image formed by the image signal for density control is detected by a toner density sensor 29 which is detecting means, and on the basis of the information thereof, a toner is supplied into the developing device. The control as described above is effected by control means 70.

Figure 4:
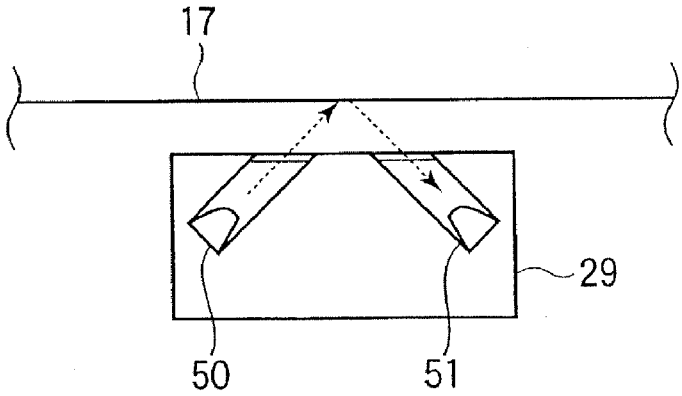
FIG. 4 schematically shows the construction of a toner density sensor used in the embodiment of the present invention.
Figure 5:
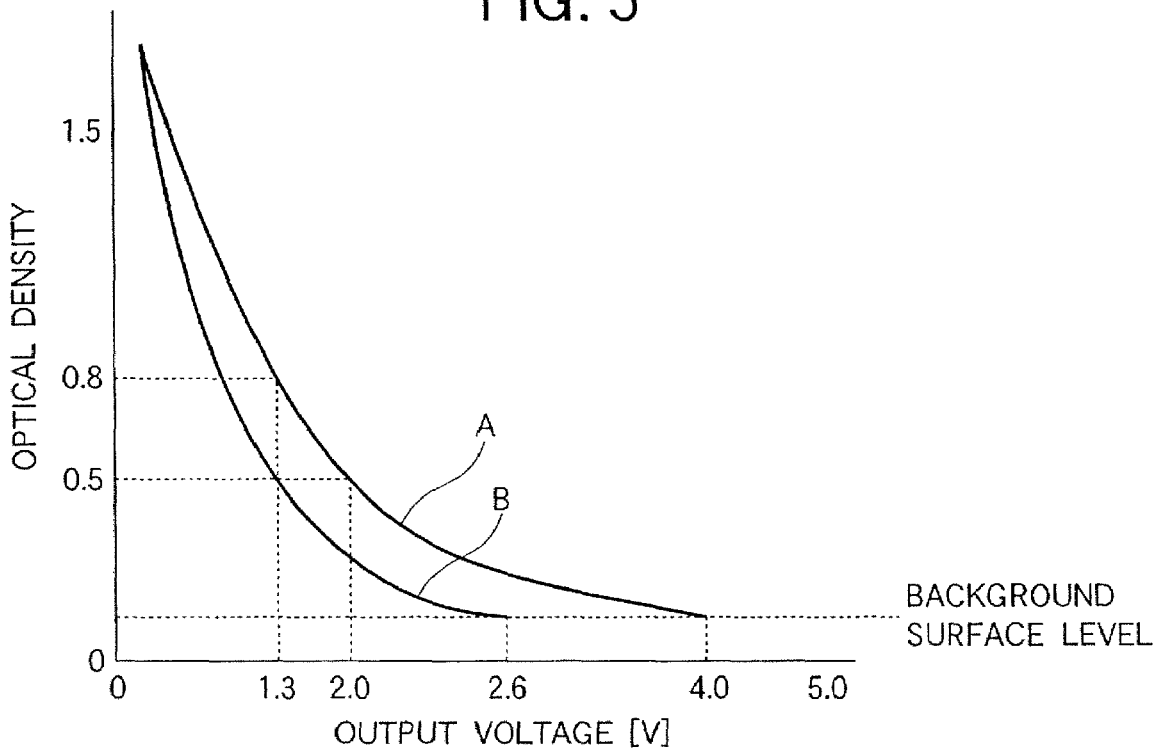
FIG. 5 shows the toner density reflection characteristic of the toner density sensor.

The toner density sensor 29 is of such a construction as shown in FIG. 4. An LED 50 which is a light source and a photodiode 51 which is a light receiving element are disposed in a sensor case. Light emitted from the LED 50 has its diffusion limited by an optical path in the case, and arrives at the surface of the drum. In order to detect only the regular reflected light of the light reflected by the surface of the drum, an optical path on the light receiving side is also limited. The distance between the surface of the sensor and the surface of the photosensitive drum is 6.0 mm, and the effective spot diameter of the light applied to the drum is 2.0 mm. FIG. 5 shows the relation between a sensor output voltage and optical density when the present source is used. The present sensor detects the regular reflected light component of the light of the LED 50 reflected by the surface of the photosensitive drum and therefore, if the toner is present, the regular reflected light component decreases and the sensor output voltage lowers. The sensor output is A/D-converted into 10 bit (0 to 1023) and is table-converted into optical density. In FIG. 5, the characteristic represented by solid line A is that in the initial case of the sensor. On the other hand, the characteristic represented by solid line B is the output characteristic when the surface of a window for preventing the stains of the LED 50 and the photodiode 51 which is provided on the surface of the sensor opposed to the drum is stained. When the surface of the window is stained, the quantity of applied light impinging on the surface of the drum and the quantity of reflected light from the surface of the drum decrease, whereby the output voltage drops even for the same amount of toner, and it is detected that the amount of toner is great. Therefore, the quantity of regular reflected light on the surface of the drum on which the toner is absent is detected, and correction is applied in accordance with that quantity of light. In the toner density sensor of the image forming apparatus of the present embodiment, adjustment is made so that 4.0 V may be outputted in a state in which the surface of the sensor is not stained. When the surface of the sensor is stained with the toner or the like, the output lowers and therefore, the stain correction value k of the output is corrected by watching the quantity of light from the surface (hereinafter referred to as the background surface) of the drum on which the toner is absent. From the relation between a measured value measured during correction timing which will be described later and 4.0 V which is an initial adjusted value, the stain correction value k is represented by the following expression:

$$k=4.0/\text{measured value}.$$

During actual toner density measurement, correction is effected by multiplying the sensor output value by the stain correction value.

For example, when the surface of the sensor is not stained, if the sensor output is 2.0 V, A/D conversion is 1023 level at 5 V and therefore, after the A/D conversion of 2.0 V, $$2.0/5.0\times1023=409 \text{ level}.$$

At this time, the toner density is table-converted so as to be 0.5. When the surface of the sensor is stained, if the actual toner density is 0.5, the output voltage of the sensor is 1.3 V and becomes 265 level by AD conversion; in ordinary table conversion, the toner density is calculated as 0.8. The sensor output of the background surface at this time is 2.6 V, and when this is A/D-converted, $$2.6/5.0\times1023=531 \text{ level},$$

and from $$4.0/5.0\times1023=818 \text{ level}$$

during 4.0 V in the standard state, the stain correction value k is $$818/531=1.540.$$

By taking the product of this value and 265 level during the toner measurement of the above-mentioned density measurement value, $$265\times1.540=408$$

is obtained, and by this value being table-corrected, 0.5 can be obtained.

Figure 3:
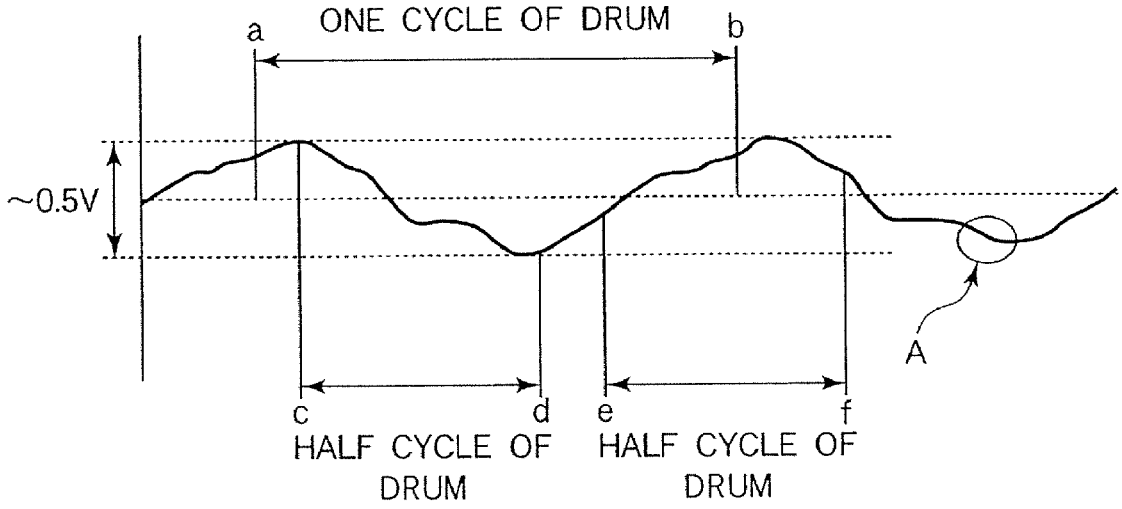
FIG. 3 is a typical view showing the reflection output characteristic of the drum cycle of the toner density sensor of a photosensitive drum.

Now, the toner density sensor utilizes the reflected light from the surface of the drum and is therefore sensitive to any change in the distance between the surface of the sensor and the surface of the photosensitive drum. The eccentricity of the photosensitive drum is of the order of 50-200 μm at one cycle of the drum. FIG. 3 is a typical view showing the manner in which the output characteristic of the background surface changes at the cycle of the photosensitive drum. Generally the eccentric component of the drum is substantially a sine wave. Therefore, the correction value of stain correction is changed by the detected position. For the stain correction, it is necessary to obtain the average characteristic of the surface of the drum. Therefore, a method of measuring the quantity of reflected light corresponding to one cycle of the drum and averaging it is also conceivable, but this method requires many measuring points and therefore, a processing load becomes great, and the light of the LED 50 of the sensor concentrates as a spot of 2 mm and therefore, if the light of the LED 50 is always applied at one cycle during correction, so-called light memory occurs to the photosensitive member, and it is considered to occur as a faulty image during image forming thereafter. It is also conceivable to install a position detecting sensor or an encoder on the photosensitive drum and control the phase of the drum to thereby make the measuring point constant, but this also leads to an increased cost and a problem in the space for the disposition or the like of the sensor. In the present invention, as shown in FIG. 3, the fluctuation from the background surface resulting from the rotation of the photosensitive drum is sine-wave-like and therefore, at a half cycle of the drum, the detection of the background is effected and for example, the average of two points c and d or two points e and f in FIG. 3 is taken, whereby a value substantially equal to the average value of one cycle of the drum can be obtained. By doing so, even if phase control such as position detection is not particularly effected, timing is measured by a timer for a time corresponding to a half of one cycle of the drum, whereby a background correction coefficient can be determined. In the construction of the image forming apparatus of the present embodiment, the diameter of the photosensitive drum is 62 mm and the process speed is 137 mm/sec. In the present embodiment, for reading of a point, the LED 50 is turned on 20/msec. before reading to thereby stabilized the quantity of emitted light thereof, whereafter the output of the photodiode 51 is sampled, and after the termination of the sampling, the LED 50 is turned off, and the sampling time is substantially 2 msec. or less. One cycle of the drum of this image forming apparatus is 1.42 sec. and therefore, sequence is set up so that after 0.71 sec. has passed after the start of the measurement of the first point, the operation of reading the second point may be started. In the image forming apparatus of the present embodiment, there is a ripple of about 0.5 V in the output voltage at the cycle of the drum. An operation for determining the stain correction coefficient k in the present embodiment is performed during the image forming pre-rotation at the start of the job, but can be carried out by inserting the present operation during the initializing rotation during the closing of a power supply switch or in the course of the job. Before the present invention is applied, there has been deviation of the order of maximum 5% in the stain correction value, but by applying the present invention, it has become possible to suppress the deviation to the order of 2%. The controlling time has taken 1.42 sec. for the measurement of one cycle of the drum, but it has become possible to effect control in 0.71 sec., and the first copying time could be shortened by 0.71 sec.

Also, in the present embodiment, control was effected at a half of the cycle of the drum, but in an apparatus free of the problem of the controlling time, it is also possible to effect the control at a quarter cycle. In this case, relative to the first measurement, four data in total are taken in such a manner as the second measurement after a quarter cycle, the third measurement after ¾ cycle, and the fourth measurement after ¾ cycle, and the average value of these is used.

Also, while in the present embodiment, correction has been effected on the output value of the photodiode 51, a similar effect can be obtained by controlling the light quantity of the LED 50 so that the same output as the initial value (in the present embodiment, 4.0 V) may be obtained.

Figure 7:
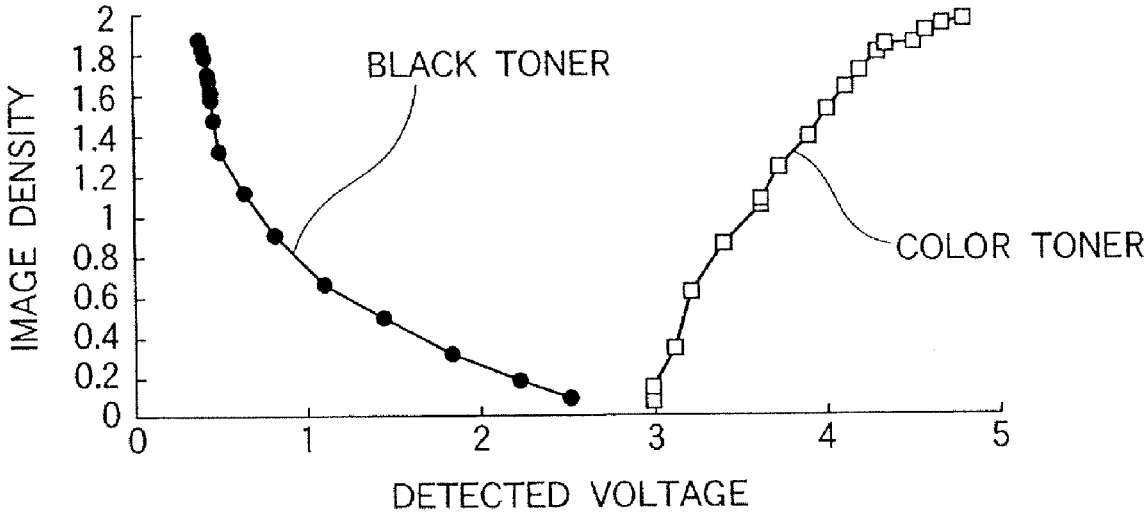
FIG. 7 shows the toner density reflection characteristics of a toner density sensor in an example of the conventional art and a toner density sensor in another embodiment.
Figure 8:
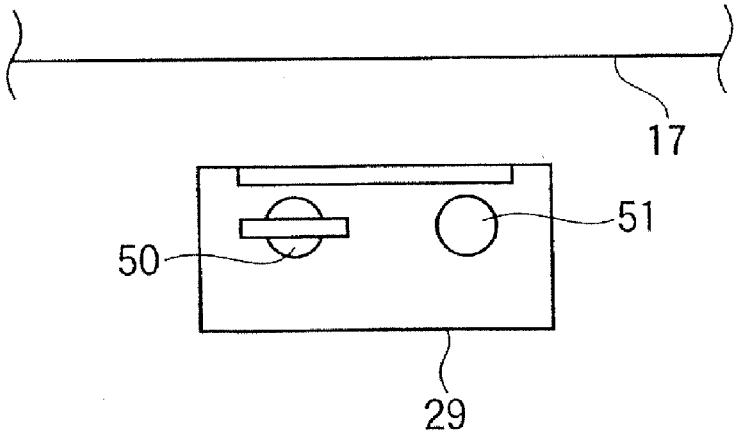
FIG. 8 schematically shows the construction of the toner density sensor in the example of the conventional art and of the toner density sensor in another embodiment of the present invention.
Figure 9:
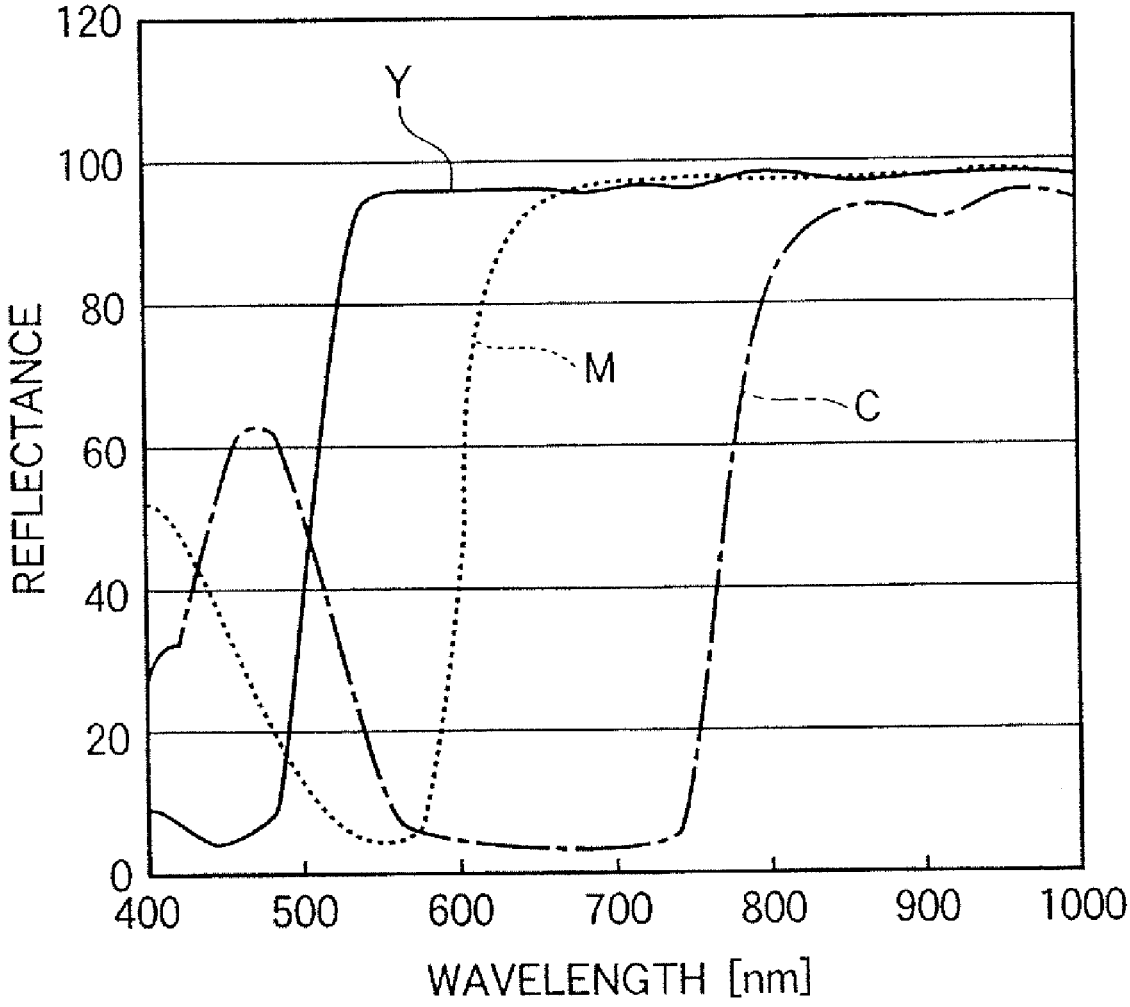
FIG. 9 shows an example of the spectral reflection characteristics of toners.

Further, while in the present embodiment, description has been made of the toner density sensor utilizing regular reflected light, such a sensor as shown in FIG. 8 is also applicable. This is a sensor utilizing a reflecting characteristic including that of not only regular reflected light, but also scattered light without regulating the optical path. The output characteristic of the sensor in that case is such that as shown in FIG. 7, regarding Y, M and C toners, as the toners formed on the photosensitive drum become more, reflected light increases more and the output of the photodiode 51 increases more than when no toner image is formed on the photosensitive drum, and conversely, regarding the black toner, as the amount of adhering toner increases, the output of the photodiode 51 lowers. FIG. 7 uses optical reflection density as an index indicative of the amount of adhering toner. The Y, M and C color toners and the Bk toner differ in characteristic from one another, but by making such design that the values of the quantities of reflected light from the surface of the drum become the same in control, the same effect can be obtained. The aforedescribed predetermined cycle need not always be quite the same, but may be within a range which enables an improvement in accuracy to be achieved.

Second Embodiment

Figure 2:
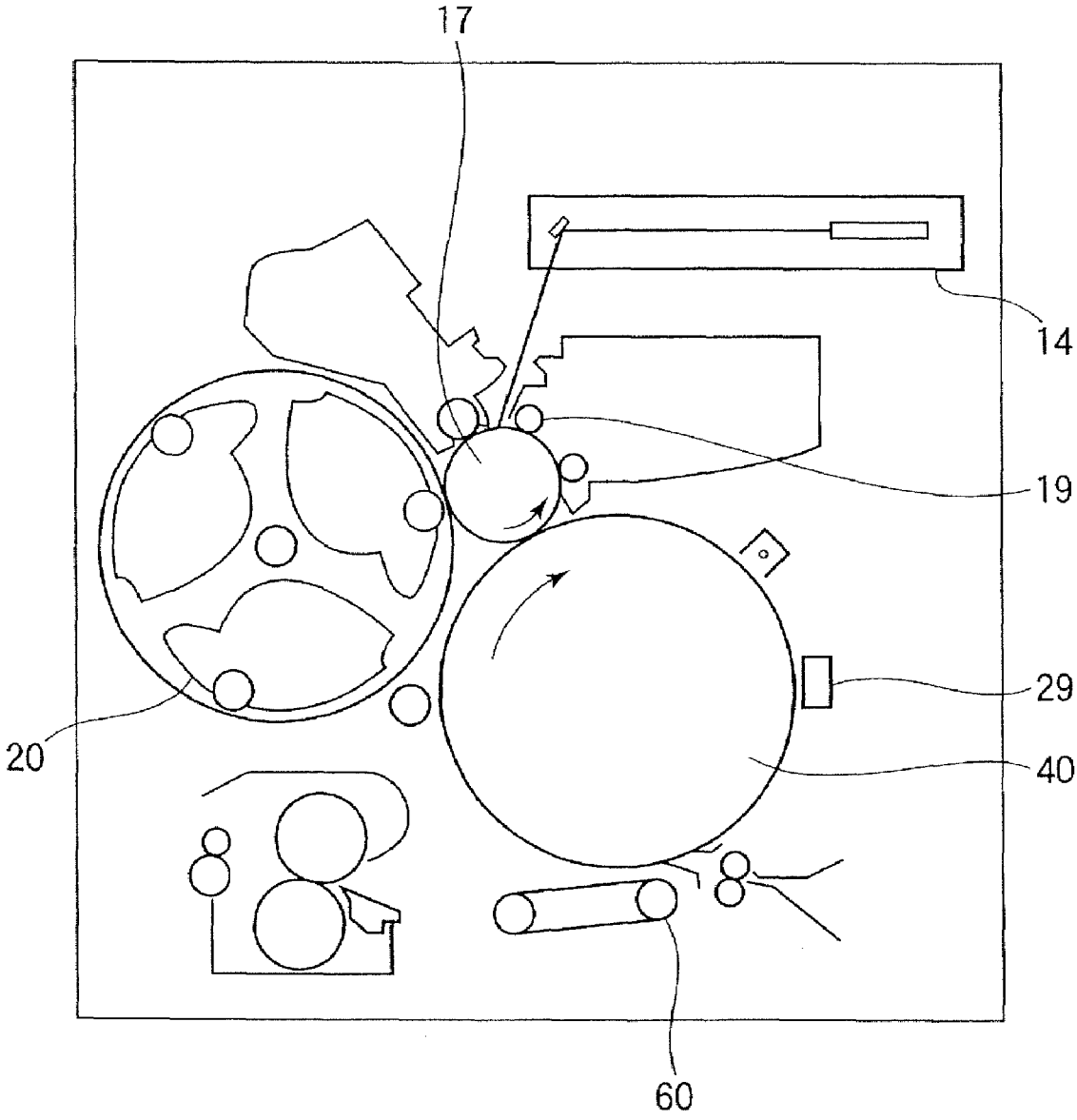
FIG. 2 schematically shows the construction of an image forming apparatus according to a second embodiment of the present invention.

While in the first embodiment, description has been made of an example in which the present invention is applied to the photosensitive drum, in this embodiment, description will be made of a case where the present invention is applied to an image forming apparatus in which toner density is measured on an intermediate transfer drum 40 as an image bearing member as shown in FIG. 2. The full-color image forming apparatus using an intermediate transfer member carries out the process of superimposing toner images formed as Y, M, C and K images upon the intermediate transfer member, and thereafter collectively transferring them to a transfer material P at a secondary transferring step. The diameter of the intermediate transfer drum 40 in the present embodiment is 186 mm and the eccentric component thereof is of the order of 500 μm at maximum. Again in the present embodiment, the calculation of the stain correction coefficient of the toner density sensor could be effected at a half of one cycle of the intermediate transfer drum 40 without any increase in cost. Particularly the intermediate transfer member transfers all of the full-color images of Y, M, C and K, and thereafter transfers them to the transfer material which is a recording material and thus, it is necessary for it to be capable of bearing a maximum size of image thereon and therefore, it is usually great in drum diameter as compared with the photosensitive drum. In an image forming apparatus which can output paper of A3 size, the circumferential length of the intermediate transfer drum 40 usually need be of the order of 500 mm or greater. Therefore, to enhance accuracy, it is preferable that n of 1/n cycle (n being 2 or greater integer) be an integer greater than 2 and the number of portions to be detected be made great. In this case, it is more preferable that detection be effected at even-numbered denominators such as n=2, 4, 6, 8, . . . for 1/n cycle.

Of course, the contents disclosed in the first embodiment are also applicable.

Third Embodiment

In this embodiment, description will be made of a method of more enhancing the accuracy at each reading point, and more enhancing the accuracy of the calculation of the stain correction coefficient.

Figure 6A:
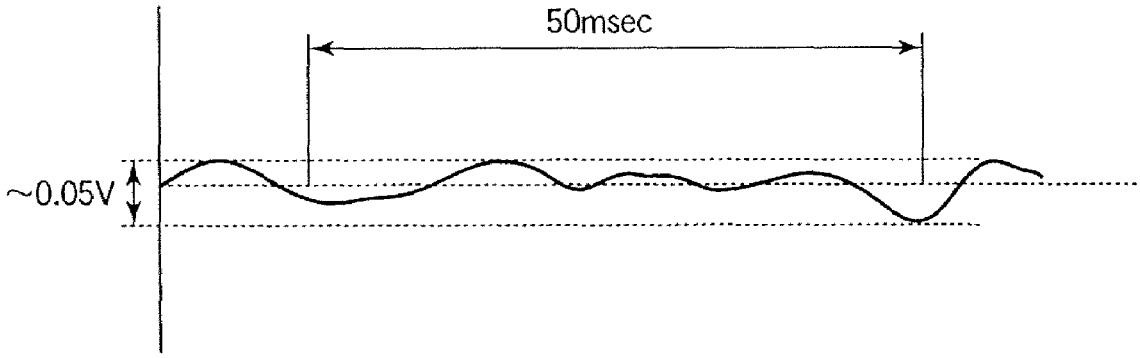
FIGS. 6A and 6B are typical graphs showing the output characteristic of the toner density sensor in the minute section of the surface of the photosensitive drum.
Figure 6B:
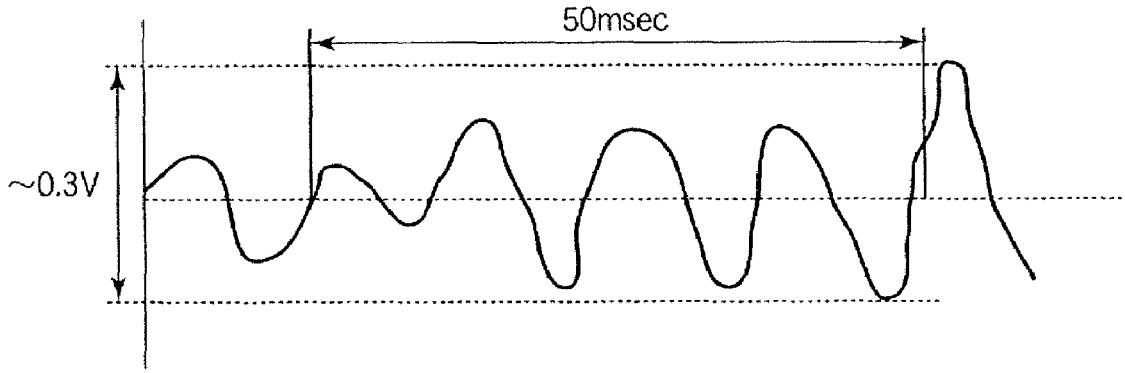

FIGS. 6A and 6B show the portion A of FIG. 3 enlarged. FIG. 6A typically shows the output fluctuation of the initial state of the photosensitive drum. FIG. 6B shows the output fluctuation after the photosensitive drum has formed and outputted about 30,000 pages of images. The surface of the photosensitive drum is deteriorated by the friction by cleaning and the discharge of the charging roller due to the repetition of the image forming operation, and minute unevenness occurs to that surface and the reflecting characteristic thereof also changes. In FIGS. 6A and 6B, there is shown a section of 50 msec., but in the initial state of the photosensitive drum, the ripple of this output is 0.05 V or less, whereas after the repetition of the image forming operation, there may sometimes occur a degree of ripple fluctuation which cannot be neglected such as the order of 0.3 V. In such case, the deterioration is the deterioration of the surface of the photosensitive drum caused by the repetition of image forming and therefore has little periodicity. So, in the present embodiment, description will be made of a method of effecting sampling a plurality of times for each reading point to thereby cope with an increase in the ripple fluctuation caused by the repetition of image forming.

The construction of the image forming apparatus of the present embodiment is similar to that of the first embodiment and therefore need not be described.

The reading in the present embodiment will now be described.

For the reading of one point the LED 50 is turned on to thereby stabilize the quantity of emitted light thereof 20 msec. before the reading, whereafter the sampling of the output of the photodiode 51 is started. The sampling is effected for 12 points at 4 msec. each from after the start of the sampling, and 10 points except a maximum value and a minimum value are averaged and the average is used as the sampling data of one point. When for example, the result of the sampling of 12 points for the reading of one point is 4.22 4.11 4.20 3.98 4.05 3.91 3.95 4.10 4.13 3.99 4.00 4.02, the average value 4.05 of 10 points except the maximum value 4.22 and the minimum value 3.91 is used as the read value of the first point.

The LED 50 is turned off after the sampling of 12 points, and one sampling time is substantially 2 msec. or less. The turn-on time of the LED 50 for the reading of one point is about 70 msec. and one cycle of the drum of this image forming apparatus is 1.42 sec. and therefore, sequence is set up so that after 0.71 sec. has passed after the start of the measurement of the first point, the operation of reading the second point may be started.

By applying the present embodiment of the invention to the construction of the first embodiment, it has become possible to suppress the deviation of the stain correction value to the order of 1% although in the first embodiment, there has been a deviation of the order of 2% in the stain correction value. Also, as a matter of course, the present embodiment is applicable to the construction of the second embodiment.

Fourth Embodiment

Figure 10:
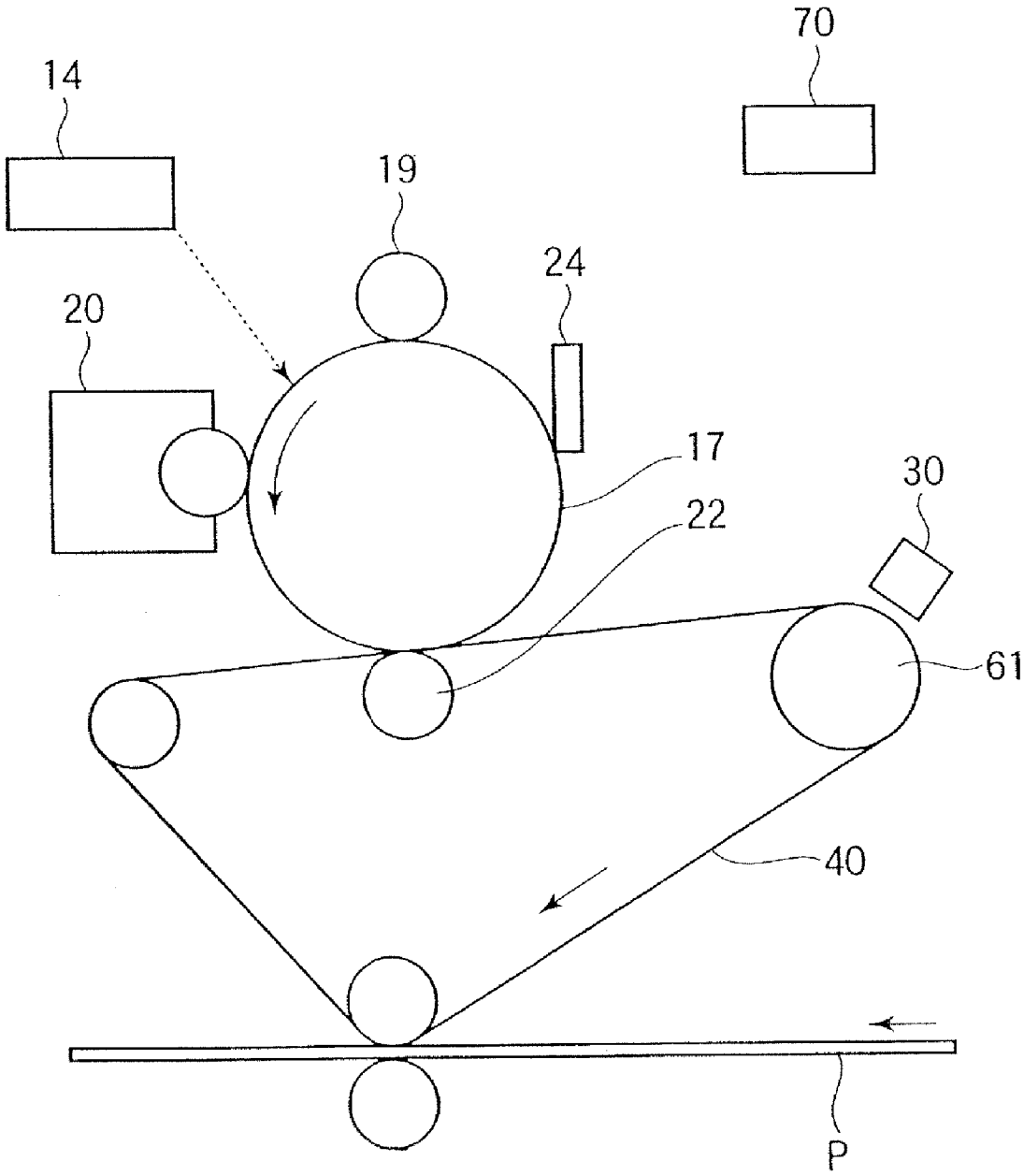
FIG. 10 schematically shows the construction of an image forming apparatus according to a fourth embodiment of the present invention.

In this embodiment, description will be made of a case where density detecting means is opposed to a roller 61 over which is passed the intermediate transfer belt 40 of an image forming apparatus using such an intermediate transfer belt as shown in FIG. 10. The same members as those in the previous embodiments are given the same reference numerals. In such a construction, a problem similar to that described in the previous embodiments is also caused by the eccentricity of the roller 61. When a belt is adopted as the intermediate transfer member, a toner density sensor 30 is mounted in opposed relationship with a roller around which the belt is stretched, whereby it is unnecessary to provide a belt supporting member on the back side of the detecting position of the sensor. In the present embodiment, the toner density sensor 30 is disposed so as to be opposed to the drive roller 61 for driving the intermediate transfer belt. The circumferential length of the intermediate transfer belt 40 is 584 mm, the diameter of the drive roller 61 in the present embodiment is 31 mm and the process speed is 137 mm/sec. One cycle of the drive roller 61 is 0.71 sec. Accordingly, a half cycle of the drive roller 61 is 0.305 sec. The eccentric component of the drive roller 61 is of the order of 100-300 μm. Although 4.26 sec. has heretofore been required for one cycle of the belt, 0.5 sec. or less has become possible.

Figure 11:
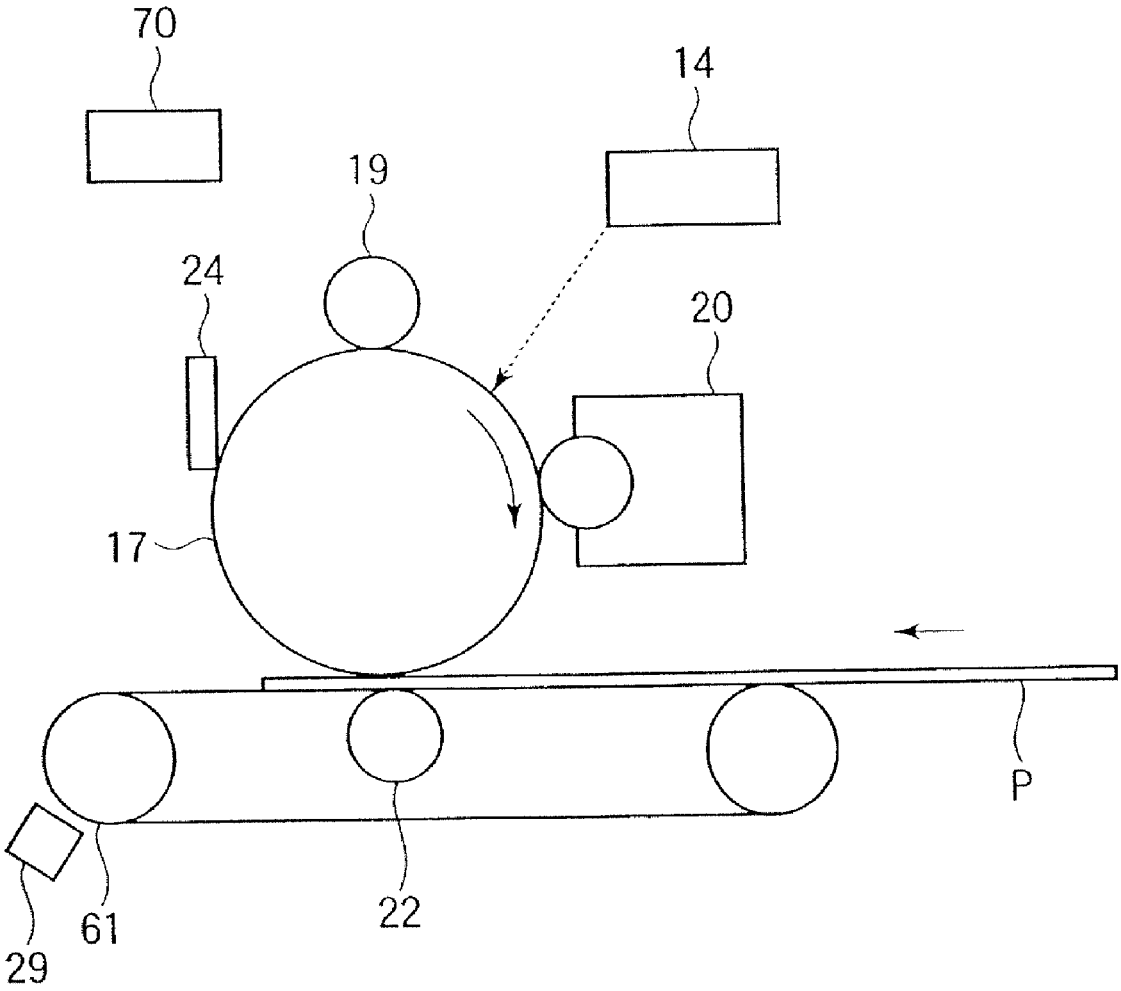
FIG. 11 schematically shows the construction of another image forming apparatus according to the fourth embodiment of the present invention.

Also, in the present embodiment, the toner density sensor is disposed in opposed relationship with the roller around which the intermediate transfer belt is stretched, but it is also possible to apply the present invention to an image forming apparatus of a construction as shown in FIG. 11 wherein a patch is formed and read on a transfer conveying belt for conveying a transfer material and effecting transfer, and a toner density sensor 29 is opposed to a roller 61 around which the transfer conveying belt is stretched.

As a matter of course, it is also possible to apply the inventions disclosed in the first, second and third embodiments.

While in the first to fourth embodiments, description has been made of an example in which the result of the detection by the toner density sensor is utilized for the control of the toner supply to the developing device, the present invention is also effective for use in the control of the charging potential of the image bearing member, the exposure condition by the exposing means, the applying condition of the developing bias applied to the developing means, etc.

This application claims priority from Japanese Patent Application No. 2003-330055 filed Sep. 22, 2003, which is hereby incorporated by reference herein.

What is claimed is:

1. An image forming apparatus comprising:

image forming means for forming a toner image on a rotatable image bearing member;

detecting means for detecting a toner patch, which is formed on the image bearing member by said image forming means, and a surface of the image bearing member, which is rotating; and adjusting means for adjusting said image forming means based on a detection result of the surface obtained by said detecting means each 1/n (n being an integer greater than or equal to 2) of a rotation period of the image bearing member and a detection result of the toner patch.

2. An image forming apparatus according to claim 1, wherein said detecting means optically performs detection.

3. An image forming apparatus comprising:

image forming means for forming a toner image on a rotatable image bearing belt supported by a rotary member;

detecting means for detecting a toner patch on the image bearing belt and a surface of the image bearing belt in an area in which the image bearing belt is supported by the rotary member; and adjusting means for adjusting said image forming means based on a detection result of the surface obtained by said detecting means each 1/n (n being an integer greater than or equal to 2) of a rotation period of the rotary member and a detection result of the toner patch.

4. An image forming apparatus according to claim 3, wherein said detecting means optically performs detection.

5. An image forming apparatus comprising:

image forming means for forming a toner image on an image bearing member;

transfer means for transferring the toner image on the image bearing member to a transfer material conveyed by a conveying belt;

a rotary member rotating and supporting the transfer belt;

detecting means for detecting a toner patch transferred on the transfer belt and a surface of the conveying belt in an area in which the conveying belt is supported by said rotary member; and adjusting means for adjusting said image forming means based on a detection result of the surface obtained by said detecting means each 1/n (n being an integer greater than or equal to 2) of a rotation period of the rotary member and a detection result of the toner patch.

6. An image forming apparatus according to claim 5, wherein said detecting means optically performs detection.

* * * * *

UNITED STATES PATENT AND TRADEMARK OFFICE

CERTIFICATE OF CORRECTION

PATENT NO. : 7,292,799 B2
APPLICATION NO. : 11/609596
DATED : November 6, 2007
INVENTOR(S) : Makoto Oki It is certified that error appears in the above-identified patent and that said Letters Patent is hereby corrected as shown below:

COLUMN 1:
Line 37, "lowers" should read -- decreases --.
Line 58, "a cost or a space" should read -- cost or space --.

COLUMN 2:
Line 36, "prefeffed" should be deleted.

COLUMN 4:
Line 55, "lowers." should read -- decreases. --.

COLUMN 5:
Line 9, "lowers" should read -- decreases --.

COLUMN 6:
Line 28, "stabilized" should read -- stabilize --.

COLUMN 7:
Line 6, "become more," should read -- increase, --.
Line 11, "lowers." should read -- decreases. --.
Line 50, "need" should read -- needs to --.
Line 63, "more" should read -- further --.
Line 64, "more" should read -- further --.

Signed and Sealed this

Eleventh Day of May, 2010

David J. Kappos

David J. Kappos
*Director of the United States Patent and Trademark Office*